United States Patent [19]

Yada et al.

[11] Patent Number: 4,466,842

[45] Date of Patent: Aug. 21, 1984

[54] FERRITIC STEEL HAVING ULTRA-FINE GRAINS AND A METHOD FOR PRODUCING THE SAME

[75] Inventors: Hiroshi Yada; Yoshikazu Matsumura; Koe Nakajima, all of Kitakyushu, Japan

[73] Assignee: Nippon Steel Corporation, Tokyo, Japan

[21] Appl. No.: 481,453

[22] Filed: Apr. 1, 1983

[30] Foreign Application Priority Data

Apr. 3, 1982 [JP] Japan ..... 57-55649
Apr. 3, 1982 [JP] Japan ..... 57-55648
Jun. 17, 1982 [JP] Japan ..... 57-102991

[51] Int. Cl.[3] ..... C21D 7/14
[52] U.S. Cl. ..... 148/12 R; 148/36
[58] Field of Search ..... 148/12 R, 36

[56] References Cited

U.S. PATENT DOCUMENTS 3,826,691 7/1974 Melloy et al. ..... 148/36
3,897,279 7/1975 Shaughnessy et al. ..... 148/36
3,994,754 11/1976 Geymond ..... 148/36
4,001,052 1/1977 Nakazato ..... 148/36
4,088,511 5/1978 Rowney ..... 148/36
4,325,751 4/1982 Josefsson ..... 148/36
4,388,122 6/1983 Sudo et al. ..... 148/36
4,400,223 8/1983 Heitmann et al. ..... 148/36

*Primary Examiner*—W. Stallard
*Attorney, Agent, or Firm*—Kenyon & Kenyon

[57] ABSTRACT

A novel hot-rolled ferritic steel composed of 70% or more of equiaxed ferrite grains having an ultra-fine grain size of 4 μm or less. This steel is produced by a hot working at approximately the $Ar_3$ point and by one or more passes of the hot working having a total reduction ratio of at least 75%. When a plurality of passes is carried out, the time between passes is less than one second. Due to hot working, dynamic transformation of austenite and/or dynamic recrystallization of ferrite takes place. The total reduction ratio may be at least 35% for a high purity steel.

6 Claims, 14 Drawing Figures

50 μ

50 μ

20μ

FERRITIC STEEL HAVING ULTRA-FINE GRAINS AND A METHOD FOR PRODUCING THE SAME

BACKGROUND OF THE INVENTION

1. Field of the Invention

The present invention relates to a ferritic steel having ultra-fine grains and more particularly to a ferritic steel having an essentially hypoeutectoid composition free of a special alloying element, such as Nb, and having ultra-fine grains in a hot-rolled state. The present invention also relates to a method for producing a ferritic steel having ultra-fine grains.

The ferritic steel herein is a steel in which the major portion of the structure thereof, usually from 70% to 80%, consists of ferritic crystal grains. The ferritic steel may comprise, depending upon the required mechanical propeties, one or more phases other than the ferrite phase, e.g., a pearlite phase, a martensite phase, and/or a retained austenite phase. The ferritic steel may further comprise precipitates such as carbides and nitrides.

2. Description of the Prior Art

The refining of crystal grains is one of the known methods for strengthening steels, enhancing the strength as well as the ductility. This technique is especially important for enhancing the quality of steels used in a hot-rolled state.

Previously, various attempts have been made to produce ferritic steel having a fine ferritic structure. This is because refinement of the crystal grains is the only method available to improve both the yield stress and, thus, the tensile strength, and the ductility, i.e., the rupture transition temperature. In one attempt, the ferritic steel is subjected to a special heat treatment. In other attempts, special alloying elements, such as niobium, titanium, or molybdenum are incorporated into the ferritic steel.

One such method for producing a ferritic steel having ultra-fine grains is disclosed in Japanese Unexamined Patent Publication No. 52-39519. This method aims to produce a non-heat-treated ferritic steel having a No. 13 grain size or higher and which exhibits excellent strength, cold formability, and ductility. In this method, titanium is introduced in an amount of from 0.1% to 0.5% of the steel or 0.5 to 3.5 times the carbon content (Ti/C=0.5 to 3.5) so as to have the titanium or titanium carbides contribute to refinement of the crystal grains and, during hot-rolling, to maintain the draft, at a rolling temperature of 850° C. or less, to 55% or more so as to suppress the growth of ferritic grains. The publication, however, does not teach the importance of the rolling time.

Japanese Unexamined Patent Publication No. 53-95121 discloses a method for producing a high tensile strength steel not using a special alloying element. This method, however, does not relate to the production of a ferritic steel having ultra-fine grains. In this method, the finishing hot-rolling temperature is at least the $Ar_3$ point so as to obtain a dual-phase mixed structure. After the completion of hot-rolling, rapid cooling is carried out at a temperature ranging from an $Ar_3$ to $Ar_1$ temperature to a temperature of 400° C. at the highest. Then, the hot-rolled strip is coiled. Here, the $Ar_3$ point means the temperature at which steels are transformed from austenite to ferrite during slow cooling from an austenite temperature, and the $Ar_1$ point means the temperature at which steels are transformed from austenite to pearlite during slow cooling from an austenite temperature. The purpose of rapid cooling before coiling is to increase the hardness of the secondary phases as much as possible and to maintain the volume percentage of the secondary phases as low as possible, thereby improving the mechanical properties. However, under the hot-rolling conditions disclosed in Japanese Unexamined Patent Publication No. 53-95121, fine ferrite grains are not formed. The draft and the rolling time, which are important for refining crystal grains, are not mentioned. Only a method for inducing a dual-phase mixed structure during cooling is disclosed.

The grain size of conventional ferrite steels having fine grains is from over 4 to 6 μm (microns). These ferrite steels are usually produced by means of a method usually referred to as controlled rolling. In controlled rolling, a ferritic steel containing a special alloying element, such as Nb, is heated, prior to hot-rolling, to a high temperature, e.g., 1,200° C. or more, so as to bring niobium or the like into the solid solution of the ferrite matrix. The finishing rolling temperature is 800° C. or less and thus is very low, and hot-rolling is carried out at a heavy draft. In this method, since hot-rolling is carried out after the temperature of a steel strip is lowered, the productivity is considerably decreased and the deformation resistance during the hot-rolling is considerably high. Since the deformation resistance is considerably high, the load applied to a rolling mill is very high, which is disadvantageous from an industrial point of view.

Other methods for producing such ferrite steels include rolling at a low slab heating temperature and forced cooling after hot-rolling. All of these, however, result in a grain size as mentioned above. None can produce, on a industrially applicable basis, crystal grains of 3 to 4 μm size.

On another front, various laboratory methods for producing a ferritic steel having ultra-fine grains have been proposed. In one of these, a nickel containing ferritic steel is repeatedly annealed, thereby alternating the temperature to first more than and then less than the transformation point. Such annealing, however, is obviously impractical industrially.

Thus, there are no conventional methods which make it possible to industrially produce a ferritic steel having a practical hypoeutectoid composition and a grain size of 4 μm or less in a hot-rolled state.

SUMMARY OF THE INVENTION

It is therefore an object of the present invention to produce a ferritic steel having ultra-fine grains not by adding a special alloying element and by a means which can be employed industrially.

In accordance with the objects of the present invention, there is provided a ferritic steel which is a hot-rolled steel containing from 0.02% to 0.3% by weight of carbon and from 0.1% to 2.0% by weight of manganese, the balance being iron and unavoidable impurities, and having a structure which is 70% or more ferrite, characterized in that the ferrite structure consists of equiaxed ferrite crystal grains having an average grain diameter of 4 μm or less. The ferritic steel having an ultra-fine grain size according to the present invention has ferrite crystal grains which are not considerably elongated in the rolling direction and are virtually equiaxed. The average grain diameter of 4 μm or less corresponds to No. 13 of the ASTM grain size number. The secondary phases other than ferrite phases are composed of at least one plase selected from the group consisting of a pearlite, a martensite, a retained austenite, a carbide, and a bainite.

The grain diameter of individual equiaxed crystal grains is calculated as the diameter of a circle which has the same area as the cross-section of the equiaxed crystal grains. The equiaxed crystal grains can be converted to circles by using optical microscope photography. The equiaxed crystal grains herein are those surrounded by grain boundaries. The sub-grain boundaries are not deemed as the grain boundaries.

The composition of the ferritic steel according to the present invention is now described. The specified carbon content according to the present invention is from 0.02% to 0.3% by weight. Generally, the larger the carbon content, the lower the amount of ferrite and the greater the amount of pearlite. In the ferritic steel according to the present invention, the amount of ferrite is greater than what would be expected from a Fe—C phase diagram. However, when the carbon content is higher than 0.3%, the amount of phases other than the ferrite phase, such as the pearlite phase, is so great that it is difficult to obtain a structure consisting of 70% or more of ferrite. When the carbon content is less than 0.02%, the grain growth becomes prominent after hot-rolling. Even if a ferritic steel containing less than 0.02% of carbon is rapidly cooled after finishing hot-rolling, the ferrite crystal grains cannot be ultra-refined.

The specified manganese content is from 0.1% to 2.0% by weight. Manganese is usually added to steels so as to, for example, improve the hot workability or to enhance the hardenability and, thus, the strength. In the present invention, manganese is used to suppress the growth of ferrite crystal grains, which growth occurs after hot-rolling. In order to suppress the growth of ferrite crystal grains, at least 0.1% by weight of manganese is necessary. However, if the manganese content is very high, i.e., more than 2% by weight, the transformation point is lowered, and, therefore, the optimum temperature of transformation induced by hot-rolling is also lowered, which in turn tends to cause the untransformed austenite phase to remain in the hot-rolled steel.

Niobium, tantalum, molybdenum, and tungsten are known as elements which retard recrystallization in steels. Since, in the present invention, transformation and recrystallization occur during hot-rolling, thereby refining the ferrite crystal grains, the ferritic steel according to the present invention must be essentially free of nobium, tantalum, molybdenum, and tungsten, as they would hinder the refining.

The method of the present invention for producing a ferritic steel having ultra-fine grains by means of hot-rolling a steel containing from 0.02% to 0.3% of carbon, from 0.1% to 2.0% of manganese, and the balance of iron and unavoidable impurities, is characterized in that hot-rolling is carried out during cooling from a temperature higher than the $Ar_3$ point and in that, during a final stage of hot-rolling, the steel is subjected at approximately the $Ar_1$ point, e.g., from ($Ar_1$+50° C.) to ($Ar_3$+100° C.), and for less than one second to one or more workings, the total reduction ratio of the one or more workings being at least 50%.

In the method of present invention, transformation is enhanced or promoted due to strain which is produced by hot-rolling, thereby refining the ferrite crystal grains. A method which can effectively refine the ferrite crystals must be initiated at a temperature higher than the $Ar_3$ point and must end at a temperature not much lower than the $Ar_3$ point because steels must first be austenite and then must be transformed to ferrite during hot-rolling.

It should be understood that, in the usual transformation, the driving force is supercooling and that the number of ferrite crystals which are formed by such transformation is mainly determined by the number of austenite crystals. If the usual transformation is carried out and if the known methods are no employed for refining the grains of ferrite crystals, the grain diameter of the ferrite crystals is usually from 8 to 10 μm or is sometimes greater than 10μ.

Continuous hot-rolling is carried out so that the reduction ratio of one pass or the total reduction ratio of two or more passes amounts to 80%. Alternatively, if the pass time is less than one second, the reduction ratio of one pass or the total reduction ratio of two or more passes amounts to at least 50%. The working strain induced during hot-rolling causes enhancement of the $Ar_3$ point of the austenite which remains untransformed. According to a discovery made by the present inventors, if the austenite transforms to ferrite at the moment, or shortly after, the austenite is subjected to rolling or other working, the thus transformed ferrite crystals are ultra-fine and equiaxed. The present invention extensively utilizes the working strain as the driving force of transformation. It is believed that the grain refinement of ferrite crystals occurs through the repeated process of precipitation of fine ferrite phases along the grain boundaries of the austenite, worked directly above the $Ar_3$ point, directly or shortly after the working and the precipitation of new ferrite phases at the interface between the ferrite and the austenite phases upon application of a further working strain. If the working strain is satisfactorily high, the new ferrite phases are formed in the entire steels.

In the present invention, steels may be air-cooled after being hot-rolled. According to a preferred embodiment of the present invention, in which a smaller grain size is obtained, the rate of cooling after hot-rolling from the finishing temperature down to a temperature of 600° C. or less is at least 20° C./sec. The heat cycle from 600° C. to room temperature may vary depending upon the properties required for a ferritic steel. For example, if a high strength is required for a ferritic steel, rapid cooling down to approximately room temperature should be carried out. If a high formability is required for a ferritic steel, rapid cooling down to a temperature of approximately 400° C. and slow cooling from this temperature down to approximately room temperature should be carried out, thereby causing the solute carbon to precipitate.

To suppress growth of crystal grains after working, a large cooling rate is desirable. If the reduction ratio or total reduction ratio is very high or if the working temperature is on the low side of the temperature range according to the present invention, i.e., from ($Ar_1$+50° C.) to ($Ar_3$+100° C.), however ultra-fine grains will result in ferritic steels having a small cross-section even if they are allowed to cool naturally. In this case, the cooling rate or heat cycle need not be specified. Accelerated cooling, however, is necessary if the reduction ratio of one pass or the total reduction ratio of two or more passes is approximately 50%, if the cross-section of a ferritic steel is large, or if the finishing temperature is high.

BRIEF DESCRIPTION OF THE DRAWINGS

The present invention is hereinafter described with reference to the drawings, in which.

DESCRIPTION OF THE PREFERRED EMBODIMENTS

Figure 1:
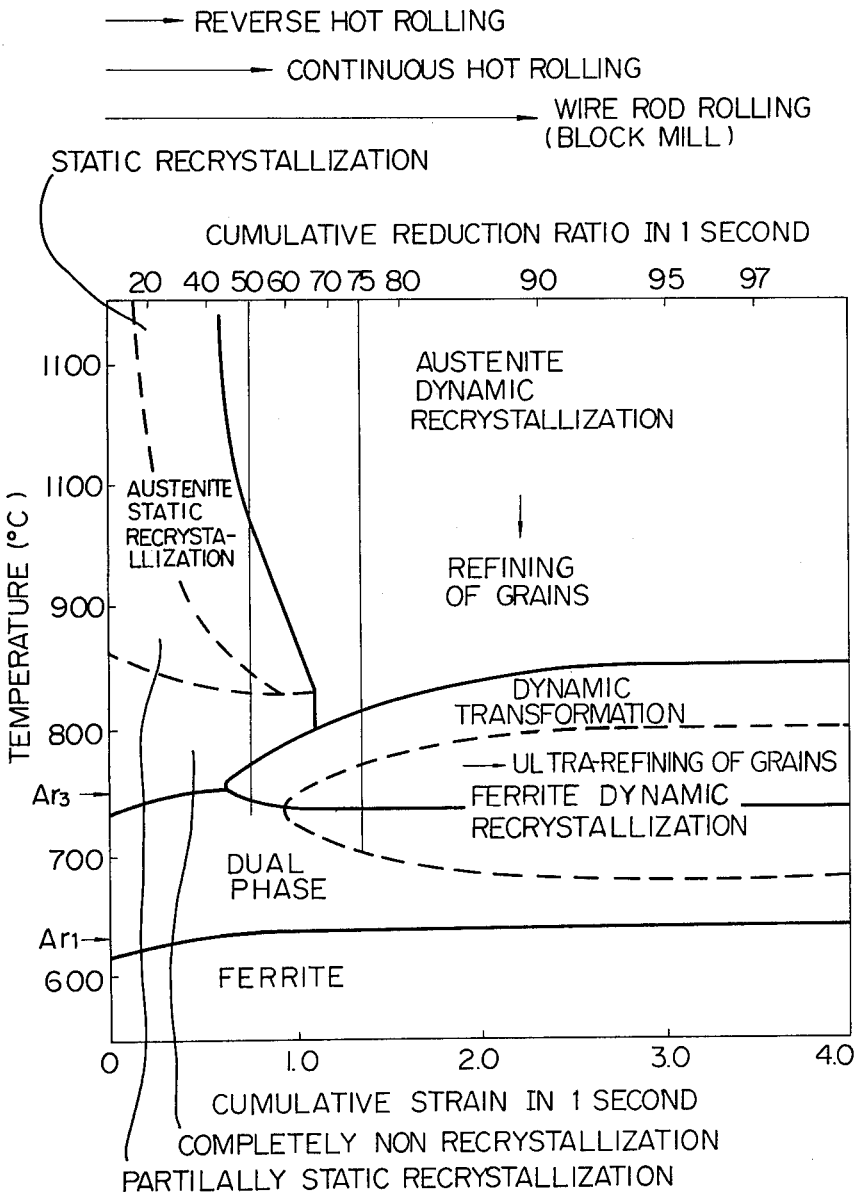
FIG. 1 illustrates the results of experiments in which 0.15%C-1%Mn steels were rapidly cooled directly after hot-rolling and then the structure thereof was investigated.

As is understood from the summary of the invention, according to the present invention, mechanical properties superior to conventional ones are obtained and high quality, high tensile strength steels can be produced without using an alloying element.

Steel having the composition described above may be subjected to any process before subjected to the working process according to the present invention. Steel having the composition described above is melted in a conventional manner and, when molten, may be subjected to continuous casting or ingot-making followed by rough rolling so as to produce a slab. The slab may be brought to a hot-rolling process while it retains a high temperature. Alternatively, the slab may be cooled down to room temperature, reheated, and then brought to a hot rolling process. The above described continuous casting and the like, however, are not limitative at all.

The working step of a slab according to the present invention is carried out usually at the final stage of, for example hot-rolling. Usual conditions may be applied for at all stages except the final one. However, generally speaking, the heating and hot-rolling conditions are desirably such that the grain diameter of austenite crystals are small.

Various hot-working methods can be used in the present invention, for example, plate rolling, hot strip rolling, and wire rod rolling. Hot-working methods, other than hot-rolling, such as hot extrusion and hot forging, may also be used in the present invention.

According to a preferred embodiment of the present invention, the ferritic steel is an alloyed steel containing, in addition to carbon, 3% or less of manganese and one or more alloying elements, not including niobium, tantalum, tungsten, or molybdenum. Manganese adjusts the transformation points and is contained in an amount of from 0.1% to 2.0%.

If the content of the alloying elements is more than 3%, the $Ar_3$ point is too low to refine the crystal grains. Regarding niobium, tantalum, molybdenum, and tungsten, as explained in the summary, these elements retard the recrystallization and transformation of austenite. Since, in the present invention, the crystal grains are refined through the transformation of austenite to ferrite and the recrystallization of ferrite, these elements cannot be used.

No special alloying element other than manganese is essential for refining the crystal grains according to the present invention, but any may be used for other purposes so long as they do not drastically suppress the transformation of austenite to ferrite induced by working.

Alloying elements usually used are silicon and chromium, which have a high solubility limit, are usual accompanying elements of steels, and usually enhance strength and improve ductility or toughness.

Silicon is generally used as a deoxidizing agent. A slight amount of silicon used for deoxidization remains in steels. This residual silicon strengthens the steels due to solid solution hardening. Addition of an appreciable amount of silicon to the ferritic steel according to the present invention facilitates the ferrite formation and promotes the ferrite transformation. Too high a silicon content, however, raises the optimum temperature of working induced transformation is induced due to working. This in turn results in coarsening of the ferrite crystals after working. Therefore, the silicon content is preferably 1.5% at the maximum.

Chromium, as well as nickel, cobalt, and copper, exert virtually the same influence on the ferritic steel as manganese, however, are industrially uneconomical. The chromium, nickel, cobalt, and copper content is therefore also preferably 2% at the maximum.

Aluminum, titanium, and zirconium are generally added to steels, so as to deoxidize them or strengthen them due to formation of carbonitrides. Since these carbonitrides are formed in the ferrite phases as a rule, addition of these elements does not impede the transformation of austenite to ferrite. If the contents of these elements are too high, however, the elements will remain in the ferritic steel as coarse precipitates, thereby causing the properties of the ferritic steel to deteriorate. The aluminum, titanium, and zirconium contents are therefore 0.1%, 0.03%, and 0.03% at the maximum, respectively.

Calcium and rare earth elements are generally added in a small amount so as to control the shape of nonmetallic inclusions in steels and to improve workability. The shape control and workability-improvement may be carried out in the present invention, if necessary. Too high a content of calcium or rare earth elements, however, will increase the amount of nonmetallic inclusions. The calcium or rare earth element content is therefore preferably 0.1% at the maximum.

Vanadium strengthens steels due to its formation of carbonitrides mainly in the ferrite phases. The vanadium content is preferably 0.1% at the maximum, since too much vanadium in steels retards the transformation of austenite to ferrite.

According to a preferred embodiment of the present invention, the phosphorus content is 0.015% or less, the sulfur content is 0.010% or less, and the nitrogen content is 0.0025% or less. These impurities raise the recrystallization temperature of ferrite, thus, the lower the contents, the more desirable for refining of the crystal grains. Puriicaton of steels to the phosphorus, sulfur, and nitrogen contents described above is technically possible in the mass production of the ferritic steel according to the present invention. The ferritic steel, according to the present invention, in which the phosphorus, sulfur, and nitrogen contents are 0.015% or less, 0.010% or less, and 0.025% or less, respectively, is hereinafter referred to as a "high purity steel".

According to a preferred embodiment of the present invention, the high purity steel is subjected to working of high reduction of at least 35% at a temperature ranging from 600° C. to ($Ar_3$+100° C.). According to a discovery by the present inventors, transformation of austenite to ferrite is induced by working. Ferrite crystals having ultra-fine grains are formed during the transformation. These ferrite crystals recrystallize and are further refined, in accordance with this preferred embodiment.

The ferritic steel according to the present invention has a tensile strength of at least 50 kg/mm$^2$ and a yield stress of at least 40 kg/mm$^2$. It also has a satisfactorily high ductility and workability as with practical steels. In addition, it exhibits a superplasticity at a particular temperature range, e.g., from 600° C. to 800° C. Therefore, at this temperature range, elongation and friction weldability are excellent. There are great industrial advantages to the present invention, because ferritic steel having the above described properties can be produced without use of a special alloying element.

The discovery of the present inventors arose during an investigation into how drafts, especially large drafts, influence the structure of hot-rolled steels. The results are shown in FIG. 1. The reduction ratio or total reduction ratio is hereinafter referred to as the reduction ratio. It was previously rather well known that in the region of FIG. 1 in which the reduction ratio is 50% or less and steels are austenitic, either static recrystallization, partially static recrystallization, or complete non recrystallization occurs depending on the temperature. It has recently been verified and is known that in the region of FIG. 1 in which the reduction ratio is high and the temperature is relatively high, dynamic recrystallization of austenite occurs. However, the present inventors for the first time discovered that there is a temperature and reduction condition under which dynamic transformation takes place.

Also, the present inventors verified that there is a temperature and reduction condition under which the dynamic recrystallization of ferrite occurs during rolling. As is 10 apparent from FIG. 1, the region of FIG. 1 in which dynamic transformation occurs and the region of FIG. 1 in which the dynamic recrystallization of ferrite occurs overlap. The 3 formation of ultrafine equiaxed crystal grains are related to dynamic transformation and to the dynamic recrytallization of 5 ferrite.

Figure 2:
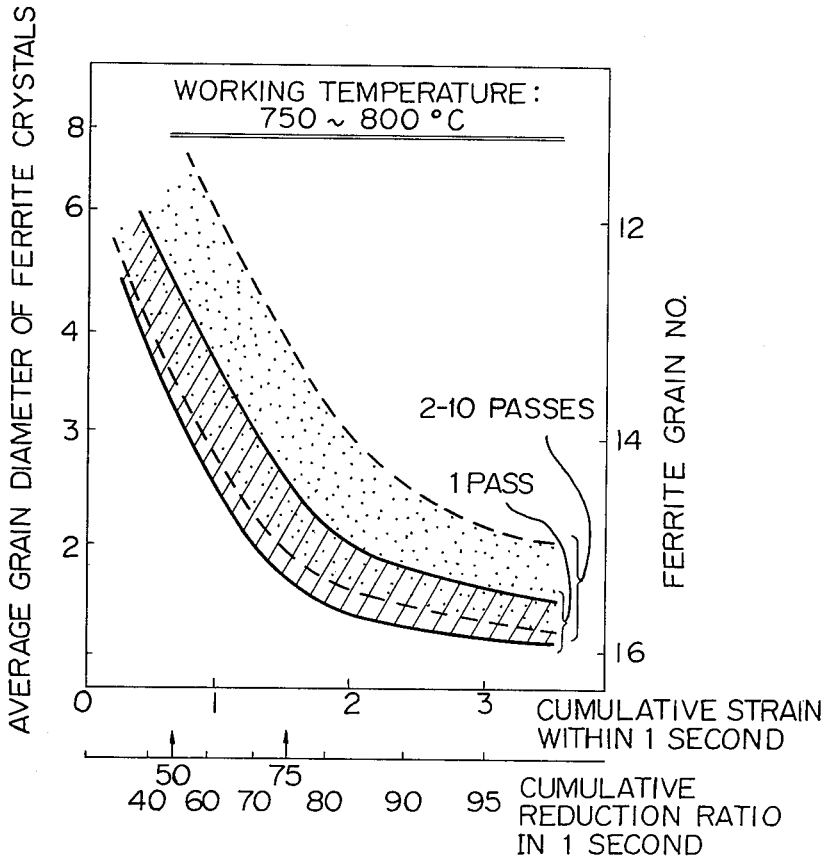
FIG. 2 illustrates the relationship between the cumulative strain in less than one second and the grain diameter ofthe ferrite crystals with regard to a 0.15%C-1%Mn steel.

As is apparent from FIG. 2, when the reduction ratio (cumulative reduction ratio in one second) is 50% or more, the average grain diameter of ferrite crystals is from 3 to 4 μm, Referring again to FIG. 1, when the reduction ratio is 50% or less and when the working temperature is from 750° C. to 800° C., dynamic transformation occurs. As is also apparent from FIG. 2, when the reduction ratio is 75% or more, the average grain diameter of ferrite crystals is 2 μm or less. As such ultra-fine grains of 2 μm or less are formed, likely that the refining of the crystal grains is rather saturated. The reduction ratio is preferably 50% or more, more preferably 75% or more.

As is apparent from FIG. 2, the reduction is preferably provided in one pass, but may also be provided in many passes during a short period of time. According to a discovery made by the present inventors, when many passes are carried out in a short period of time, the reduction should be attained in approximately one second or less to refine the crystal grains. That is, when many passes are carried out, *the total reduction* ratios of the passes carried out in approximately one second or less should be at least 50%.

Referring again to FIG. 1, it should be understood that the reduction ratio according to the present invention is not attained by means of a reverse hot-rolling mill but can be attained by means of a wire rod mill and, in the last stage, by means of a continuous rolling mill.

The hot working according to the present invention is preferably carried out in a later stage of the overall work. Occasionally, hot or cold deformation may be imparted to steels after hot working according to the present invention is carried out so as to adjust the shape of a hot-worked article. Such hot or cold deformation does not greatly deteriorate the properties of a hot-worked article according to the present invention.

Figure 3:
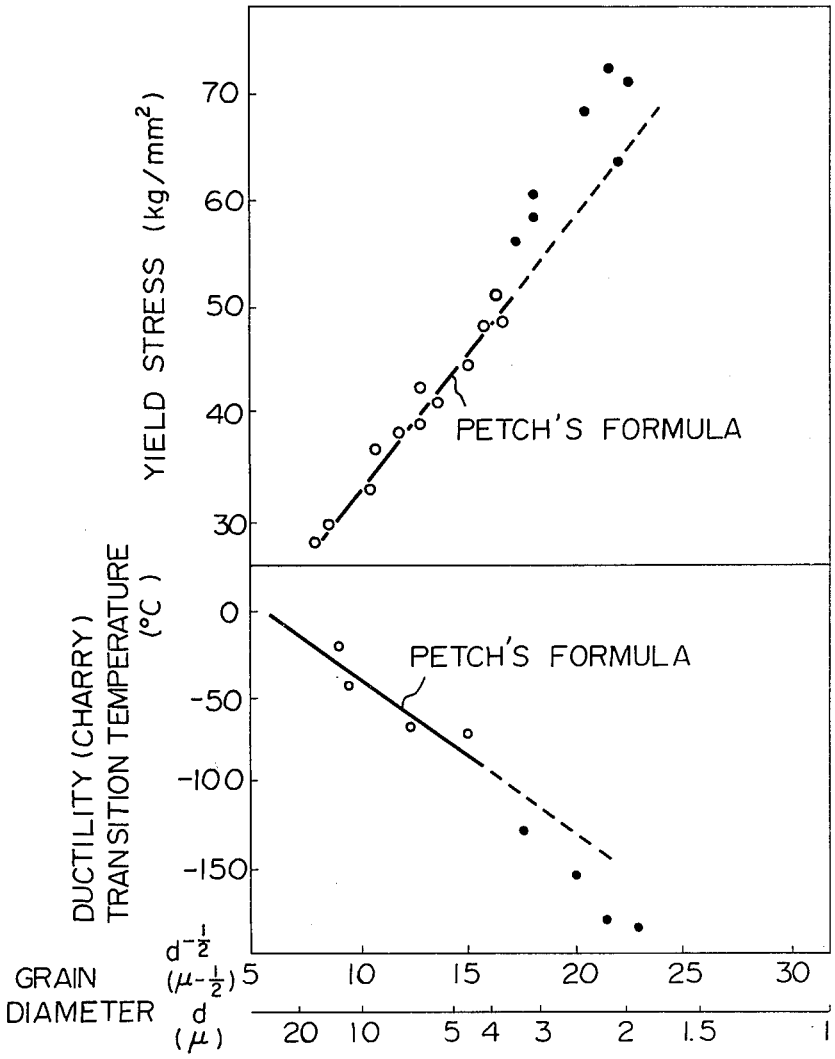
FIG. 3 illustrates the relationship between the grain diameter, the yield stress, and the ductility in terms of the ductility (charpy) transition temperature of 0.1% to 0.15C and 0.5% to 1.5%Mn steels.

Referring to FIG. 3, the yield stress, the ductility (charpy) transition temperature, and the grain diameter of ferritic steels of the present invention are shown by black dots, while the same properties of conventional ferritic steels are shown by the white dots. The data of the conventional ferritic steels conforms to the so-called Petch formula. The data for the ferritic steels according to the present invention, however, tends to be better than that obtained by extrapolation of the Petch formula.

Figure 4:
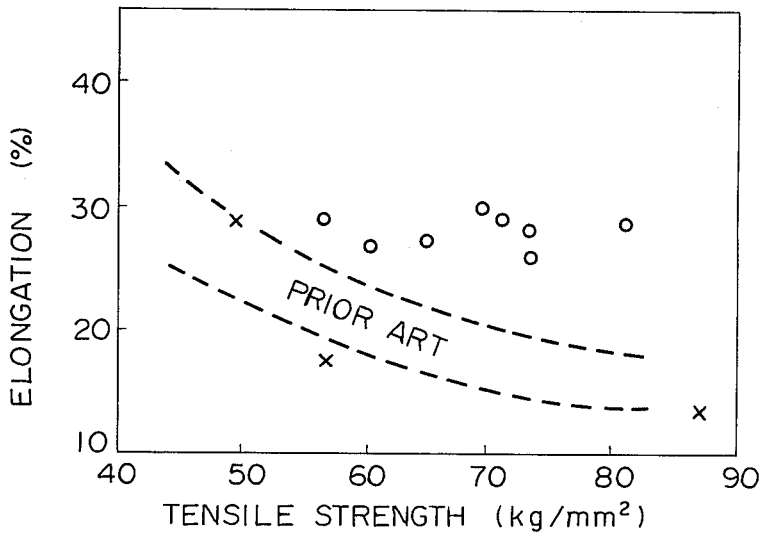
FIG. 4 illustrates the relationship between the tensile strength of the ferritic steels of the present invention and the prior art.

Referring to FIG. 4, the tensile strength and the elongation of ferritic steels according to the present invention are shown by the white dots. "Prior Art" shows the depending in the conventional ferritic steels of the tensile strength and elongation. This dependency of the conventional ferritic steels is referred to as "strength ductility balance". As apparent from FIG. 4, a ferritic steel according to the present invention having the same strength as that of a conventional ferritic steel is more ductile than such conventional ferritic steel. This is one of the features of the ferritic steel according to the present invention.

Although not illustrated in any of the drawings, another feature of the ferritic steel according to the present invention is that a ferritic steel having an average grain diameter of from 2 to 3 μm exhibits a considerably high ductility at a temperature of 600° C. or more, that is, such ferritic steel exhibits super-plasticity.

Figure 5:
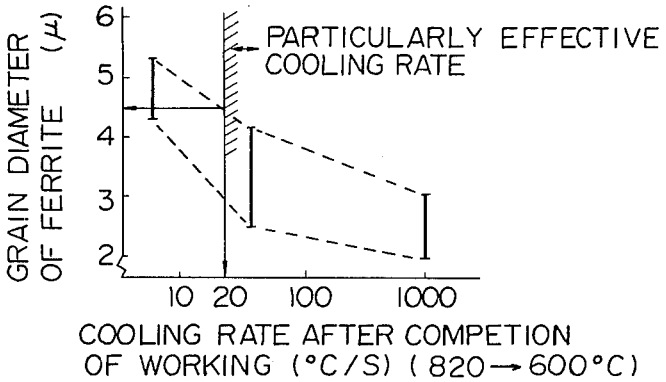
FIG. 5 illustrates the relationship between the cooling rate after completion of working and the grain diameter of ferrite crystals.

Referring to FIG. 5, the influence of the cooling rate after completion of working (hereinafter referred to as cooling) upon the grain diameter of ferrite crystals is illustrated. As is apparent from FIG. 5, a preferable cooling rate is 20° C./second or more, which is, however, not at all limitative. If the cooling rate is high and even a little untransformed austenite remains after completing the working, however, the strength of that portion can be increased since the untransformed austenite is converted to hard secondary phases which are mainly composed of bainite and/or martensite. Therefore, accelerated cooling may be used especially when high strength is necessary. The accelerated cooling is carried out at least at a temperature of 500° C. or more, or 600° C. or more, so as to transform the untransformed austenite phases to pearlite or ferrite phases and to suppress the growth of ferrite grains which are transformed from the austenite phases due to working.

It is to be noted that slow cooling may be carried out for a specific purpose, such as forming texture due to grain growth of ferrite crystals. In this case too, ferritic steel having ultra-fine grains and texture can be produced.

Figure 6:
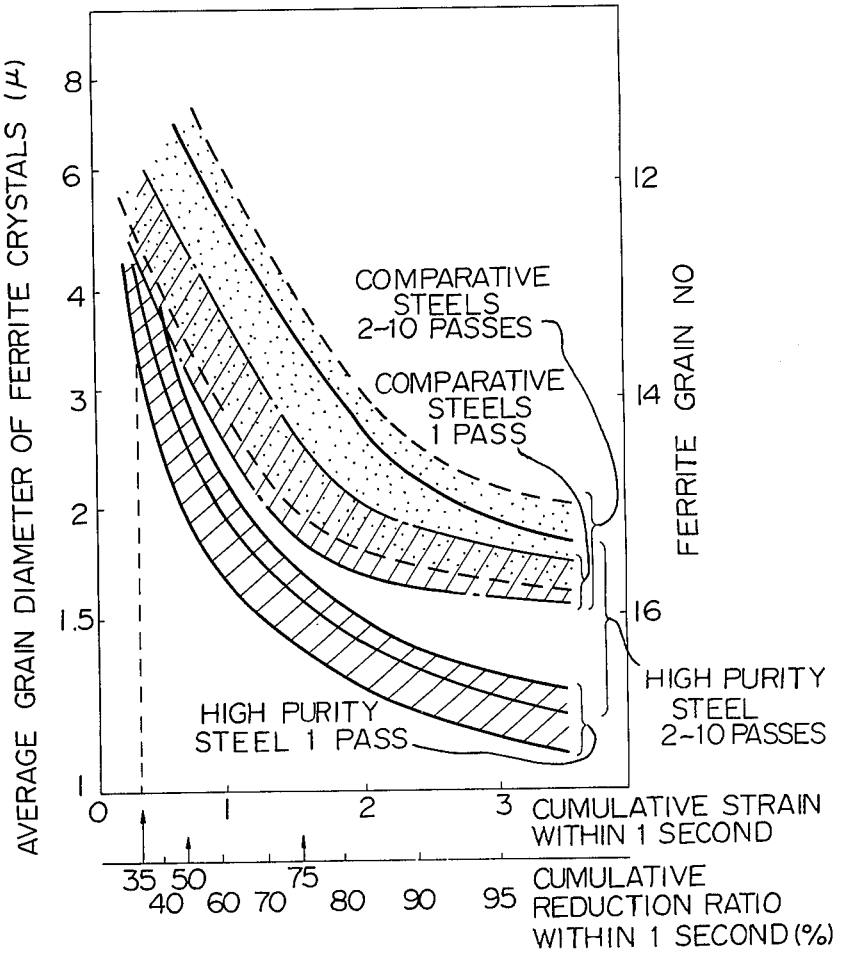
FIG. 6 is a drawing similar to FIG. 2 and illustrates the relationship between the cumulative strain in less than one second and the grain diameter of the ferrite crystals with regard to a 0.07%C-1%Mn steel.

In FIG. 6, COMPARATIVE STEELS indicates steels containing from 0.015% to 0.030% of phosphorus, from 0.008% to 0.015% of sulfur, and from 0.0025% to 0.0050% of nitrogen, while HIGH PURITY STEELS indicates the steels as defined previously.

Figure 7:
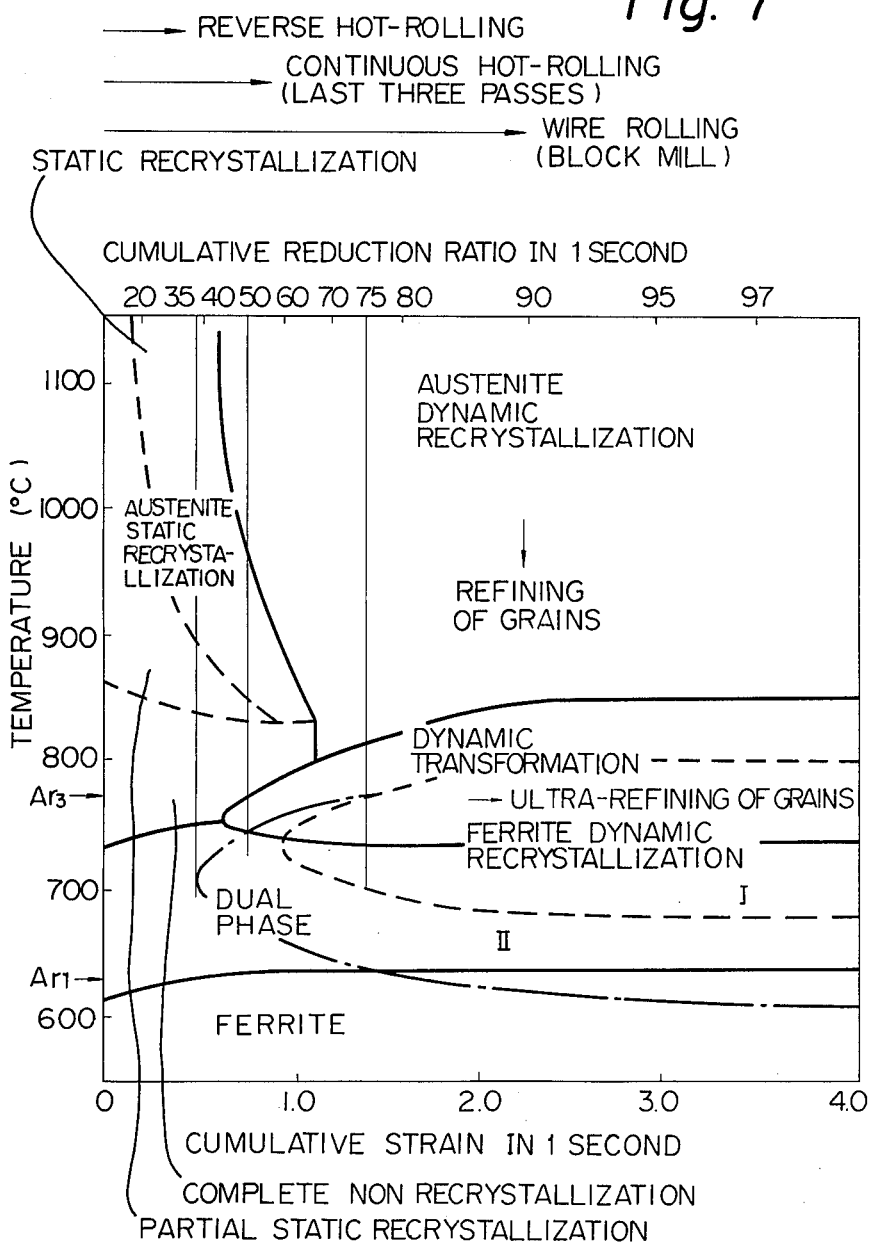
FIG. 7 is a drawing similar to FIG. 1, with regard to high purity steels.

As is clear from the figure, greater purification of steels results in a lower minimum reduction rates at which crystal grains are refined. The working temperature of the comparative steels and high purity steels were from 750° C. to 800° C. and from 650° C. to 700° C., respectively. As is also apparent from a comparison of FIG. 1 with FIG. 7, which is a drawing similar to FIG. 1, the region of ferrite dynamic recrystallization (II-in FIG. 7) is enlarged by the purifying of steels. Purifying of steels is therefore advantageous for refining the crystal grains.

Again referring to FIG. 6, "2–10 PASSES" illustrates that if the time between passes is less than approximately 1 second, strains may accumulate, thereby refining the crystal grains. Hot-working by one pass is, however, more preferable than hot working in a plurality of passes.

The present invention will now be explained hereinafter by way of examples.

EXAMPLE 1

Steels having the composition shown in Table 1 were melted in a converter and 200 mm thick slabs were produced by continuously casting these steels. The desirable finishing temperatures of steels A and B given in Table 1, determined from their $Ar_1$ and $Ar_3$ points, are from 680° C. to 870° C. and from 660° C. to 890° C., respectively.

TABLE 1

| Steel Nos. | C (%) | Si (%) | Mn (%) | Al (%) | N (%) | $Ar_1$ (°C.) | $Ar_3$ (°C.) |
|---|---|---|---|---|---|---|---|
| 1 | 0.07 | 0.02 | 1.02 | 0.019 | 0.0043 | 675 | 774 |
| 2 | 0.12 | 0.47 | 1.01 | 0.020 | 0.0020 | 658 | 789 |

The last two pass schedules of the finishing rolling were carried out by the method of the present invention (the finishing pass schedule A in Table 2), in which the reduction was 58% and the time between the passes was less than 1 second, and by a conventional method, in which the reduction was 27% and the time between the passes was less than 2 seconds.

These slabs were heated to 1100° C. and were hot-rolled by a hot strip mill. In the hot-rolling, the rough rolling was carried out by five passes, to reduce the thickness of slabs from 200 mm to 50 mm, and the finishing rolling was carried out by six passes, to reduce the thickness from 50 mm to 5 mm.

When the hot-rolled strips were conveyed from the final finishing stand of the hot strip mill, the hot-rolled strips were subjected to water cooling.

TABLE 2

| Finishing Pass Schedule | Pass | Sheet Thickness after Pass (mm) | Time Between Passes | Reduction Ratio within One Second (%) |
|---|---|---|---|---|
| A Invention | 1 | 30 | | |
| | | | 2.00 | |
| | 2 | 22 | | |
| | | | 1.46 | |
| | 3 | 17 | | |
| | | | 1.13 | |
| | 4 | 12 | | |
| | | | 0.90 | |
| | 5 | 8 | | |
| | | | 0.53 | 58 |
| | 6 | 5 | | * |
| B Comparative Example | 1 | 30 | | |
| | | | 3.00 | |
| | 2 | 20 | | |
| | | | 2.00 | |
| | 3 | 12 | | |
| | | | 1.35 | |
| | 4 | 7 | | |
| | | | 0.90 | |
| | 5 | 5.7 | | |
| | | | 0.50 | 27 |
| | 6 | 5.0 | | |

Remarks:
*Ration of Sheet Thicknesses

Eleven tests were carried out by varying the process conditions with regard to Steels 1 and 2. The finishing temperature, estimated cooling rate from 700° C. to 600° C., and the coiling temperature of these tests are given in Table 3.

The cross-sectional structures of the hot-rolled steel strips were observed by cutting the steel strips in a direction perpendicular to the sheet surfaces. The average ferrite quantity and grain diameter of ferrite crystals were obtained. The mechanical properties of the hot-rolled strips were measured by using JIS 13B specimens. In addition, the ductility (charpy transition temperatures) were measured by using 3 mm sub-size charpy specimens. The results are also shown in Table 3.

TABLE 3

| Steel Nos. | Test Nos. | Process Conditions: Rolling Pass Schedule | Finishing Temperature (°C.) | Estimated Cooling Rate (700→600° C.) (°C./s) | Coiling Temperature (°C.) | Structure (vertical to sheet plane): Average Quantity of Ferrite (%) | Average Grain Diameter of Ferrite Crystals (μ) | Tensile Properties (JIS 13B): 0.2% Proof Stress (kg/mm²) | Tensile Stress (kg/mm²) | Elongation (%) | Ductility (Charpy) Transition Temperature (3 mm subsize specimen) (°C.) |
|---|---|---|---|---|---|---|---|---|---|---|---|
| 1 | 1 | A | 850 | 25 | 510 | 80 | 4 | 48 | 58 | 30 | — |
| | 2 | A | 820 | 40 | 250 | 85 | 3 | 47 | 68 | 21 | — |
| | 3 | A | 810 | 8 | 530 | 90 | 3.5 | 43 | 62 | 25 | — |
| | 4 | A | 760 | 33 | 390 | 95 | 2.2 | 61 | 65 | 20 | −160 |
| | 5 (Comparative Example) | A | 910 | 25 | 500 | 40 | 10 | 61 | 73 | 10 | −20 |
| | 6 (Comparative Example) | A | 650 | 8 | 540 | 96 | 6 | 46 | 53 | 15 | −70 |
| | 7 (Comparative Example) | B | 810 | 40 | 250 | 60 | 8 | 45 | 58 | 13 | −80 |
| 2 | 8 | A | 820 | 40 | 250 | 85 | 3 | 47 | 71 | 20 | — |
| | 9 | A | 810 | 10 | 520 | 90 | 3.5 | 48 | 61 | 32 | — |
| | 10 | A | 730 | 35 | 390 | 98 | 1.4 | 71 | 73 | 23 | — |
| | 11 (Comparative Example) | B | 820 | 40 | 250 | 50 | 7 | 42 | 55 | 12 | — |

Test No. 5 corresponds to the conventional hot-rolling condition, in which the rolling finishing temperature is high. In this case, the amount of ferrite phases was a very small, 40% and the amount of bainite and martensite phases was large. The hot-rolled steel of Test No. 5 had a high strength, but low ductility.

In test No. 6, the rolling finishing temperature was low, and the steel being rolled was ferritic. The structure of this steel was composed of relatively coarse ferrite and pearlite crystals which were elongated in the rolling direction. This steel had therefore a normal worked structure. Therefore, the average grain and subgrain diameter of ferrite crystals of this steel was large, and the strength and ductility of this steel were low.

In Test Nos. 7 and 11, the reduction was low. The transformation therefore occurred during cooling. Thus, the ferrite grains could not be satisfactorily refined. The secondary phases, such as the pearlite and bainite phases, amounted to approximately 40%. The steels of these tests had a rather high strength, but did not have a satisfactorily high ductility.

The microscopic structure of the hot-rolled steel of test No. 4 (present invention) and the hot-rolled steel of test Nos. 5 and 6 (comparative examples) are described with reference to FIGS. 8 through 11.

Figure 8:
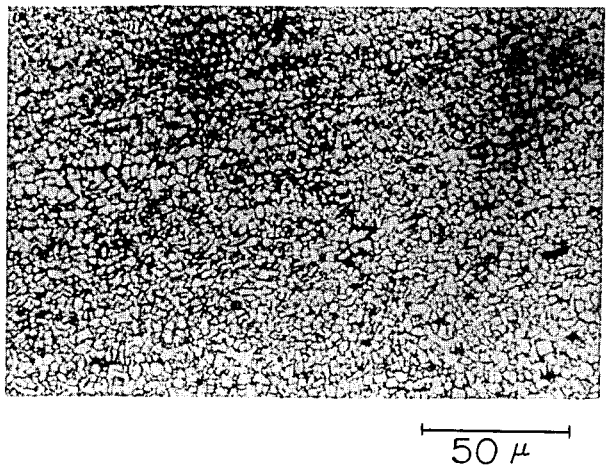
FIG. 8 is an optical microscope photograph of a ferritic steel according to an example of the present invention.
Figure 9:
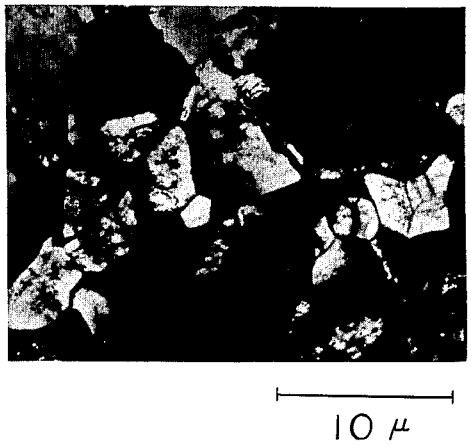
FIG. 9 is an electron microscope photograph of a ferritic steel according to an example of the present invention.

As is apparent from FIG. 8, majority of the structure consists of ultra-fine equiaxed ferrite grains. FIG. 9 shows the electron micrograph of the hot-rolled steel of test No. 4 by a higher magnification than that of FIG. 8. In FIG. 9, the ultra-fine equiaxed ferrite grains are shown in contrasts. As is apparent from FIG. 9, the ferrite grains have an average grain diameter of 4 μm or less and amount to more than 70% of the structure. The ferrite grains are contiguous to each other at great inclination angles, that is, the crystal orientations of the neighboring grains are largely different from each other.

The ferrite of the hot-rolled steel of Test No. 6 is composed of the grains (normal grains) and subgrains. The crystal orientations of the subgrains are only slightly different from each other. Even if the subgrains are fine, that is, even if the steel having a ferritic structure is hot-rolled to refine the grains of such steel, the refinement of grains is not very effective for enhancing the mechanical properties.

Since the structure of the steel according to the present invention is obtained after hot-rolling, it is evident that the substructure is formed in grains which are surrounded by boundaries having large inclination angles and, further, due to such substructure, that the disclocation density is increased and the subgrain structure is formed.

Since the mechanical properties of steels are determined by the average value of the minor portions, it is indispensable for obtaining excellent properties that the ultra-fine grains amount to 70% or more of the structure as shown in FIG. 8. The amount of ultra-fine grains can amount to virtually 100% depending upon the production conditions of the ferritic steel.

The amount of ferrite phases and the secondary phases shown in FIGS. 8 and 9, are greater and smaller, respectively, than that calculated from the carbon content. This is a feature of the ferritic steel according to the present invention.

Figure 10:
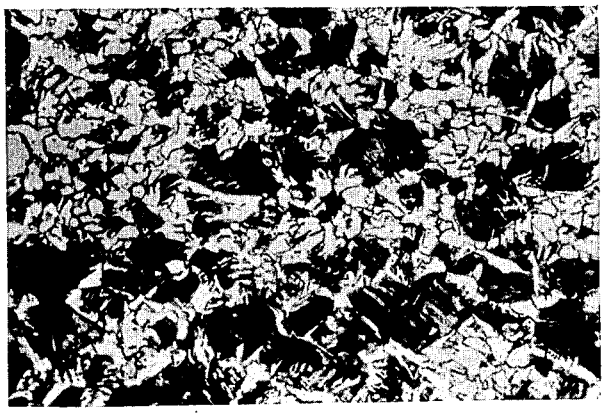
FIGS. 10 and 11 are optical microscope photographs of ferritic steels of the comparative examples.

As is apparent from FIG. 10, which is an optical microscope photograph of a comparative steel according to test No. 5, the amount of ferrite of the comparative steel is only 40% of the structure, and the remaining structure is composed of the bainite and martensite phases. This structure results in low elongation of this steel.

Figure 11:
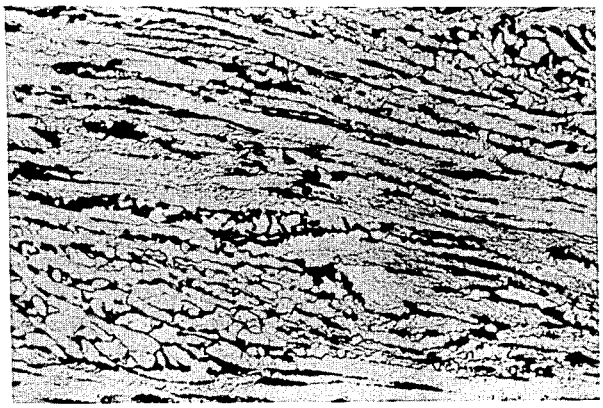

As is apparent from FIG. 11, which is an optical microscope photograph of a comparative steel according to test No. 6, the amount of ferrite of the comparative steel is approximately 85% of the structure. However, the grains are elongated and the comparative steel has a deformed structure. The deformed structure results in low elongation and strength of the steel.

EXAMPLE 2

Steels having the composition shown in Table 4 were melted in a converter and were then continuously cast so as to form 200 mm thick slabs. A special refining technique was used for reducing the impurities of Steel No. 3.

TABLE 4

| Steels | C (%) | Si (%) | Mn (%) | P (%) | S (%) | N (%) | Al (%) | $Ar_1$ (°C.) | $Ar_3$ (°C.) | Recrystallization Temperature (°C.) |
|---|---|---|---|---|---|---|---|---|---|---|
| 3 | 0.07 | 0.03 | 1.05 | 0.006 | 0.001 | 0.0009 | 0.011 | 679 | 778 | 640 |
| 4 | 0.07 | 0.02 | 1.02 | 0.023 | 0.012 | 0.0043 | 0.019 | 675 | 774 | 710 |

These slabs were heated to 1100° C. and then hot-rolled by a hot strip mill so as to produce 5 mm thick hot-rolled strips. In the rough rolling, seven passes were carried out, to reduce thickness from 200 mm to 50 mm. The finishing rolling pass schedule was as shown in Table 5. The finishing temperature of hot-rolling was from 900° C. to 1000° C.

The pass schedules A and B were carried out in accordance with the method of the present invention. That is, in the pass schedule A, the sixth pass was carried out earlier than 1 second after the fifth pass, and the reduction ratio was 58%. In the pass schedule B, the sixth pass was carried out eariler than 1 second after the fifth pass, and the reduction ratio was 44%. The pass schedule C was carried out in accordance with a conventional method, in which the reduction ratio of the last two passes was 27%.

TABLE 5-continued

| | Pass | Sheet Thickness after Pass (mm) | Time between Passes (seconds) | Reduction Ratio within One Second (%) |
|---|---|---|---|---|
| | | | 0.53 | 44 |
| | 6 | 5 | | |
| C (Comparative Example) | 1 | 30 | | |
| | | | 3.00 | |
| | 2 | 20 | | |
| | | | 2.00 | |
| | 3 | 12 | | |
| | | | 1.35 | |
| | 4 | 7 | | |
| | | | 0.90 | |
| | 5 | 5.7 | | |
| | | | 0.57 | 27 |
| | 6 | 5.0 | | |

TABLE 6

| Steel Nos. | Test Nos. | Process Conditions: Rolling Page Schedule | Finishing Temperature (°C.) | Estimated Cooling Rate (700→600° C.) (°C./s) | Coiling Temperature (°C.) | Structure (vertical to sheet plane): Average Quantity of Ferrite (%) | Average Grain Diameter of Ferrite Crystals (μ) | Tensile Properties (JIS 13B): 0.2% Proof Stress (kg/mm²) | Tensile Stress (kg/mm²) | Elongation (%) |
|---|---|---|---|---|---|---|---|---|---|---|
| 1 | 1 | A | 820 | 40 | 250 | 85 | 2.7 | 49 | 75 | 26 |
| | 2 | A | 650 | 20 | 400 | 97 | 1.8 | 62 | 77 | 23 |
| | 3 | B | 760 | 40 | 250 | 80 | 3.5 | 45 | 67 | 28 |
| | 4 (Comparative Example) | C | 820 | 40 | 250 | 30 | 10 | 41 | 65 | 17 |
| 2 | 5 (Comparative Example) | B | 820 | 40 | 250 | 60 | 6 | 41 | 63 | 12 |
| | 6 (Comparative Example) | A | 650 | 20 | 400 | 95 | | 61 | 69 | 10 |

Six tests were carried out under the process conditions as shown in Table 6. In the tests other than test Nos. 2 and 6, the hot-rolled strips were subjected to strong spray cooling on a run out table. The mechanical properties of the hot-rolled strips are also shown in Table 6.

TABLE 5

| | Pass | Sheet Thickness after Pass (mm) | Time between Passes (seconds) | Reduction Ratio within One Second (%) |
|---|---|---|---|---|
| A | 1 | 30 | | |
| | | | 2.00 | |
| | 2 | 22 | | |
| | | | 1.46 | |
| | 3 | 17 | | |
| | | | 1.13 | |
| | 4 | 12 | | |
| | | | 0.90 | |
| | 5 | 8 | | |
| | | | 0.53 | 58 |
| | 6 | 5 | | |
| B | 1 | 30 | | |
| | | | 2.00 | |
| | 2 | 21 | | |
| | | | 1.40 | |
| | 3 | 13 | | |
| | | | 0.87 | |
| | 4 | 9 | | |
| | | | 0.60 | |
| | 5 | 6 | | |

As is apparent from Table 6, a tensile strength of more than 60 kg/mm² and elongation of more than 20% are obtained by the method according to the present invention.

Figure 12:
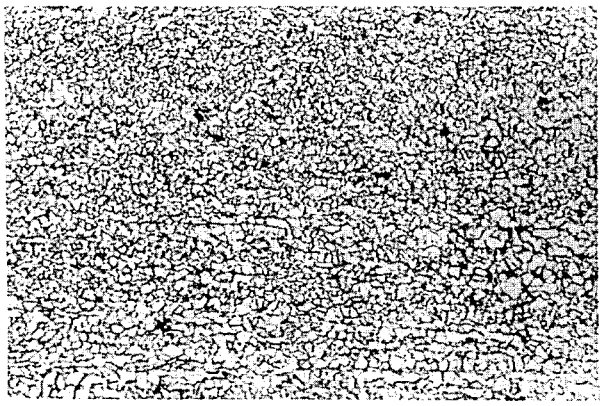
FIG. 12 is an optical microscope photograph of ferritic steels according to an example of the present invention.

In FIG. 12, the optical microscope structure of the steel according test No. 2 is shown. As is apparent from FIG. 12, the steel is essentially composed of equiaxed ultra-fine grains having a size of from 1 to 3 μm.

In test No. 4, the reduction ratio was low. Therefore, the elongation of the steel according to test No. 4 was low. This was because fine ferrite crystals were not formed, but the austenite was hardened.

In test No. 5, the reduction ratio was high enough, but, due to the high content of impurities, the dynamic recrystallization of ferrite and refining of grains were unsatisfactory. The ductility of the steel according to test No. 5 was therefore low.

In test No. 6, not only did dynamic recrystallization of ferrite occur, but also the ferrite grains were elongated in the rolling direction. The strength of the steel according to Test No. 6 was high, but the elongation was very low.

EXAMPLE 3

Steels having the composition shown in Table 7 were melted in a converter and were then continuously cast so as to form 200 mm thick slabs.

TABLE 7

| | C | Si | Mn | Al | N | (°C.) $Ar_1$ | $Ar_3$ |
|---|---|---|---|---|---|---|---|
| 5 | 0.07 | 0.02 | 1.02 | 0.019 | 0.0043 | 675 | 774 |
| 6 | 0.12 | 0.47 | 1.01 | 0.020 | 0.0020 | 658 | 789 |

The ranges of finishing temperature according to the present invention, which range is calculated from the composition of steels Nos. 5 and 6, are from 680° C. to 870° C. and from 660° C. to 890° C., respectively. These slabs were heated to 1100° C. and then hot rolled by a hot strip mill so as to produce 5 mm thick hot rolled strips. In the rough rolling, seven passes were carried out, to reduce thickness from 200 mm to 50 mm. The finishing rolling pass schedule was as shown in Table 8. The finishing temperature of hot rolling was from 900° C. to 1000° C.

The pass schedule A was carried out in accordance with the method of the present invention. That is, in the pass schedule A, the sixth pass was carried out eariler than 1 second after the fifth pass, and the reduction ratio was 58%.

The pass schedule B was carried out in accordance with a conventional method, in which the reduction ratio of the last two passes was 27%. Six tests were carried out under the process conditions as shown in Table 9. In the test other than test Nos. 3, 6, and 10, the hot-rolled strips were subjected to strong spray cooling on a run out table so as to obtain a cooling rate higher than 20° C./sec. The mechanical properties of the hot-rolled strips are also shown in Table 9.

TABLE 8

| | Pass | Sheet Thickness after Pass (mm) | Time between Passes (seconds) | Reduction Ratio within One Second (%) |
|---|---|---|---|---|
| A | 1 | 30 | | |
| | | | 2.00 | |
| | 2 | 22 | | |
| | | | 1.46 | |
| | 3 | 17 | | |
| | | | 1.13 | |
| | 4 | 12 | | |
| | | | 0.90 | |
| | 5 | 8 | | |
| | | | 0.53 | 58 |
| | 6 | 5 | | |
| B | 1 | 30 | | |

TABLE 8-continued

| | Pass | Sheet Thickness after Pass (mm) | Time between Passes (seconds) | Reduction Ratio within One Second (%) |
|---|---|---|---|---|
| (Comparative Example) | | | 3.00 | |
| | 2 | 20 | | |
| | | | 2.00 | |
| | 3 | 12 | | |
| | | | 1.35 | |
| | 4 | 7 | | |
| | | | 0.90 | |
| | 5 | 5.7 | | |
| | | | 0.57 | 27 |
| | 6 | 5.0 | | |

TABLE 9

| Steel Nos. | Test Nos. | Process Conditions: Rolling Pass Schedule | Finishing Temperature (°C.) | Estimated Cooling Rate (700→600° C.) (°C./s) | Coiling Temperature (°C.) | Structure (vertical to sheet plane): Average Quantity of Ferrite (%) | Average Grain Diameter of Ferrite Crystals (μ) | Tensile Properties (JIS 13B): 0.2% Proof Stress (kg/mm²) | Tensile Stress (kg/mm²) | Elongation (%) |
|---|---|---|---|---|---|---|---|---|---|---|
| 5 | 1 | A | 850 | 25 | 510 | 80 | 4 | 48 | 58 | 30 |
| | 2 | A | 820 | 40 | 250 | 85 | 3 | 47 | 68 | 21 |
| | 3 | A | 810 | 8 | 530 | 90 | 3.5 | 43 | 62 | 25 |
| | 4 | A | 760 | 33 | 390 | 95 | 2.2 | 61 | 65 | 20 |
| | 5 (Comparative Example) | A | 910 | 25 | 500 | 40 | 10 | 61 | 73 | 10 |
| | 6 (Comparative Example) | A | 650 | 8 | 540 | 85 | 6 | 46 | 53 | 15 |
| | 7 (Comparative Example) | B | 810 | 40 | 250 | 60 | 8 | 45 | 58 | 13 |
| 6 | 8 | A | 820 | 40 | 250 | 85 | 3 | 47 | 71 | 20 |
| | 9 | A | 810 | 10 | 520 | 90 | 3.5 | 48 | 61 | 32 |
| | 10 | A | 730 | 35 | 390 | 98 | 1.4 | 71 | 73 | 23 |
| | 11 (Comparative Example) | B | 820 | 40 | 250 | 50 | 7 | 42 | 55 | 12 |

As is apparent from Table 9, a tensile strength of more than 60 kg/mm² and elongation of more than 20% are obtained by the method according to the present invention.

Figure 13:
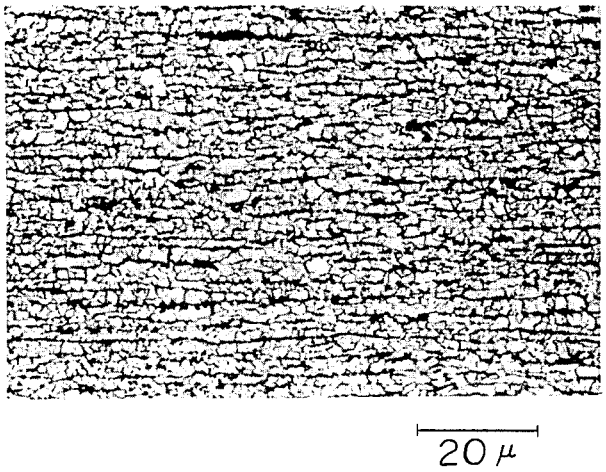
FIGS. 13 and 14 are microscope photographs of ferritic steels according to an example of the present invention and of the prior art, respectively, the steels being hot-rolled at a high finishing temperature.

In FIG. 13, the optical microscope structure of the steel according Test No. 4 is shown. As is apparent from FIG. 13, the steel is essentially composed of equiaxed ultra-fine grains having size of from 2 to 3 μm.

Figure 14:
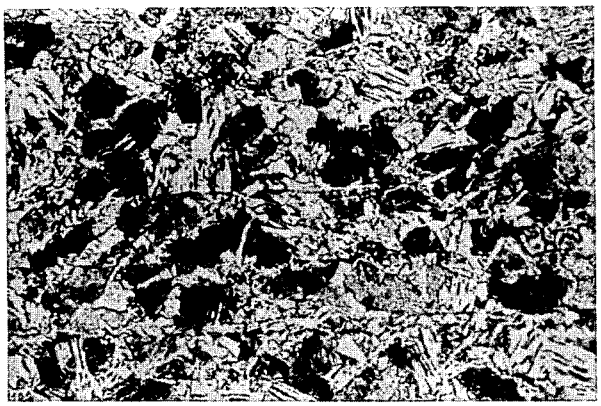

In test No. 5, the finishing rolling was carried out at a conventional high temperature. Since the hot-rolled steel strip was rapidly cooled from the high finishing temperature, the strength was high but ductility was low. The structure of the steel according to test No. 13 is shown in FIG. 14. As is apparent from FIG. 14, more than 50% of the structure was the hardened structure, and the ferrite crystals were acicular. This suggests that the transformation took place during the rapid cooling.

In test No. 9, the finishing rolling temperature was lower than that according to the present invention. Ferrite grains were therefore not satisfactorily refined, with the result that the strength was not very high.

In test Nos. 7 and 11, the total reduction was low. The ferrite grains were rather well refined, and the amount of secondary phases was large due to rapid cooling. Therefore, the strength was increased, though it was still lower than that of the present invention. Due to rapid cooling, the proportion of the secondary phases to the ferrite phases was considerably high, however, thus the elongation was low.

We claim:

1. A ferritic steel containing from 0.02% to 0.3% of carbon and from 0.1% to 2.0% of manganese, the balance being iron and unavoidable impurities, being essentially free of niobium, tantalum, molybdenum, and tungsten, being composed of 70% or more of ferrite at a hot-worked state, a ferrite structure consisting of equiaxed ferrite crystal grains having an average grain diameter of 4 μm or less, secondary phases other than ferrite phases being composed of at least one phase selected from the group consisting of a pearlite, a martensite, a retained austenite, a carbide, and a bainite, and said ferrite crystal grains having essentially no orientation due to elongation thereof by working.

2. A ferritic steel according to claim 1, wherein said equiaxed ferrite crystal grains are formed, during said working, by a dynamic transformation of an austenite phase or by a dynamic transformation of an austenite phase and a dynamic recrystallization of a ferrite phase.

3. A ferritic steel according to claim 1, wherein the composition of ferrite is 80% or more.

4. A ferritic steel according to claim 1, wherein said secondary phases are composed of at least one phase selected from the group consisting of said bainite and martensite.

5. A method for producing a ferritic steel according to claim 1, wherein hot-working is carried out during cooling from a temperature higher than the $Ac_3$ point and in that during a final stage of hot-working said steel is subjected at a temperature of from ($Ar_1$+50° C.) to ($Ar_3$+100° C.) and for less than one second to one or more workings, the total reduction ratio of the one or more workings being at least 50%.

6. A method according to claim 5, wherein a forced cooling at a cooling rate of 20° C./second or more is carried out during cooling after completion of said hot-working, at least in a high temperature region of 600° C. or more.

* * * * *